US006073924A

United States Patent [19]

Lin et al.

[11] Patent Number: 6,073,924

[45] Date of Patent: Jun. 13, 2000

[54] PAPER-LOADING MECHANISM FOR A DOCUMENT DUPLICATING MACHINE

[75] Inventors: Chin-I Lin, Tao Yuan City; Tsang-Huai Chang, Chang-Hua; Tsing-Kuan Lai, ChangHua County, all of Taiwan

[73] Assignee: Umax Data Systems, Hsinchu, Taiwan

[21] Appl. No.: 09/048,958

[22] Filed: Mar. 26, 1998

[51] Int. Cl.[7] ..... B65H 1/08

[52] U.S. Cl. ..... 271/147; 271/127

[58] Field of Search ..... 271/126, 127, 271/147, 157

[56] References Cited

U.S. PATENT DOCUMENTS

| | | | |
|---|---|---|---|
| 4,925,177 | 5/1990 | Nakamura et al. | 271/127 |
| 5,228,673 | 7/1993 | Osonoe | 271/127 |
| 5,853,171 | 12/1998 | Halpenny | 271/126 |

FOREIGN PATENT DOCUMENTS

| | | | |
|---|---|---|---|
| 0039638 | 3/1984 | Japan | 271/127 |
| 0048843 | 3/1985 | Japan | 271/126 |
| 0176227 | 7/1988 | Japan | 271/127 |

*Primary Examiner*—H. Grant Skaggs
*Attorney, Agent, or Firm*—W. Wayne Liauh

[57] ABSTRACT

A paper-loading mechanism for a document duplicating machine, which is driven by a reciprocating part in a document duplicating machine and performs periodical paper-loading control on a paper loader of the document duplicating machine, comprises an actuating unit, a transmitting unit, a paper-feeding pushrod, and a torsion spring. The actuating unit is utilized to provide reciprocating motion for the paper-loading mechanism for a document duplicating machine and is pushed by the reciprocating part along a line parallel and adjacent to one end of the trajectory of the reciprocating part. The transmitting unit is connected with the actuating unit and is used to transfer the reciprocating motion from the actuating unit to the feeding pushrod. The paper-feeding pushrod is located along one side of the paper loader of the document duplicating machine and is rotated along its own longitudinal central axis. The torsion spring is used to restore torsion energy and to drive smoothly the feeding pushrod, with one end thereof connected with the feeding pushrod and another connected with the transmitting unit.

5 Claims, 3 Drawing Sheets

PAPER-LOADING MECHANISM FOR A DOCUMENT DUPLICATING MACHINE

BACKGROUND OF THE INVENTION (1) Field of the Invention

The invention relates to a paper-loading mechanism for a document duplicating machine, and more particularly to which is driven by a reciprocating part in a document duplicating machine and performs periodical paper-loading control on a paper loader of the document duplicating machine; such as copy machine, printer, facsimile machine, scanner, imager, and any as the like.

(2) Description of the Prior Art

Conventionally, continuous paper-conveying and periodical paper-loading of either origin or blank paper on a document duplicating machine is carried out by controlling one or a plurality of paper loaders. The document duplicating machine can be a copy machine, a printer, a facsimile machine, a scanner, an imager, and any as the like.

It is well known in the art that two mechanisms are usually facilitated to perform such paper-conveying and paper-loading control; they are a clutching mechanism ( ex. U.S. Pat. No. 5,213,426) and a double-motor mechanism. In general application, the paper loader to go with the double-motor mechanism usually has a spring device to provide secure contact between the top paper in the paper loader and a paper-loading roller. However, the spring device is seldom seen in a duplicating machine with a clutching mechanism.

In a clutching mechanism, controls for paper-conveying and paper-loading are separated by a clutch. Though a single motor is used in the clutching mechanism, yet the cost is higher for its complicate control clutching elements and synthesis.

On the other hand, the double-motor mechanism applies two independent motors to perform paper-conveying and paper-loading separately. Although, the application of motors and control are simple, yet the dynamics characteristics of the double-motor mechanism is complicated and much unpredictable. Apparently, the two vibration sources, i.e. these two motors, will contribute a lot to dynamics uncertainty in the document duplicating machine.

Therefore, an invention devoting to resolving aforesaid disadvantages of conventional paper-loading mechanism for a document duplicating machine is necessary, definitely.

SUMMARY OF THE INVENTION

Accordingly, it is a primary object of the present invention to provide a paper-loading mechanism for a document duplicating machine synthesized by simple elements, for executing paper-loading operation from a paper loader of a document duplicating machine.

It is another object of the present invention to provide a paper-loading mechanism for a document duplicating machine, which is conveniently assembled, easily maintained, and low-cost at no sacrifice of the efficiency.

The paper-loading mechanism for a document duplicating machine according to the present invention, which is applied to a document duplicating machine having a reciprocating part and a paper loader with a base plate, comprises an actuating unit, a transmitting unit, and a paper-feeding unit. Wherein the reciprocating part, which provides the driving force to the paper-loading mechanism for a document duplicating machine, can be an ink-spraying head, a read-and-write head, or any as the like in the document duplicating machine.

The actuating unit, which is utilized to provide reciprocating motion for the paper-loading mechanism for a document duplicating machine, can be a motion part pushed, by the reciprocating part, along a line parallel and adjacent to one end of the trajectory of the reciprocating part.

Preferably, the actuating unit comprises a sliding block, a rack fixed to the sliding block, and a driven gear meshed with the rack. Also, preferably, the actuating unit can comprise a slider and a swingarm.

The transmitting unit is connected with the actuating unit and used to transfer the reciprocating motion from the actuating unit to a feeding pushrod. The quantity of the transferred reciprocating motion to the feeding pushrod can be equivalent to, larger than, or smaller than the quantity of the reciprocating motion from the actuating unit, by means of gear set, friction wheel set, or any as the like. Preferably, the transmitting unit can be a rope-and-wheel combination, a gear set, a friction wheel set, or a pulley-and belt set.

The paper-feeding unit, which is driven by the transmitting unit and transforms the input motion to rotation as one to push the lifting plate of the paper loader upwards for paper feeding, comprises preferably the feeding pushrod and a torsion spring. The feeding pushrod, which rotates along its own longitudinal central axis and further comprises a base plate fixed along the longitudinal surface, is located along one side of the paper loader of the document duplicating machine; with one end thereof connected with the torsion spring, and with the base plate extruding to bottom of one side of the base plate. Preferably, the lifting plate can be the base plate.

The torsion spring, with one end connected with the feeding pushrod and another connected with the transmitting unit, is used to restore torsion energy and to drive smoothly the feeding pushrod.

All these objects are achieved by the paper-loading mechanism for a document duplicating machine described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
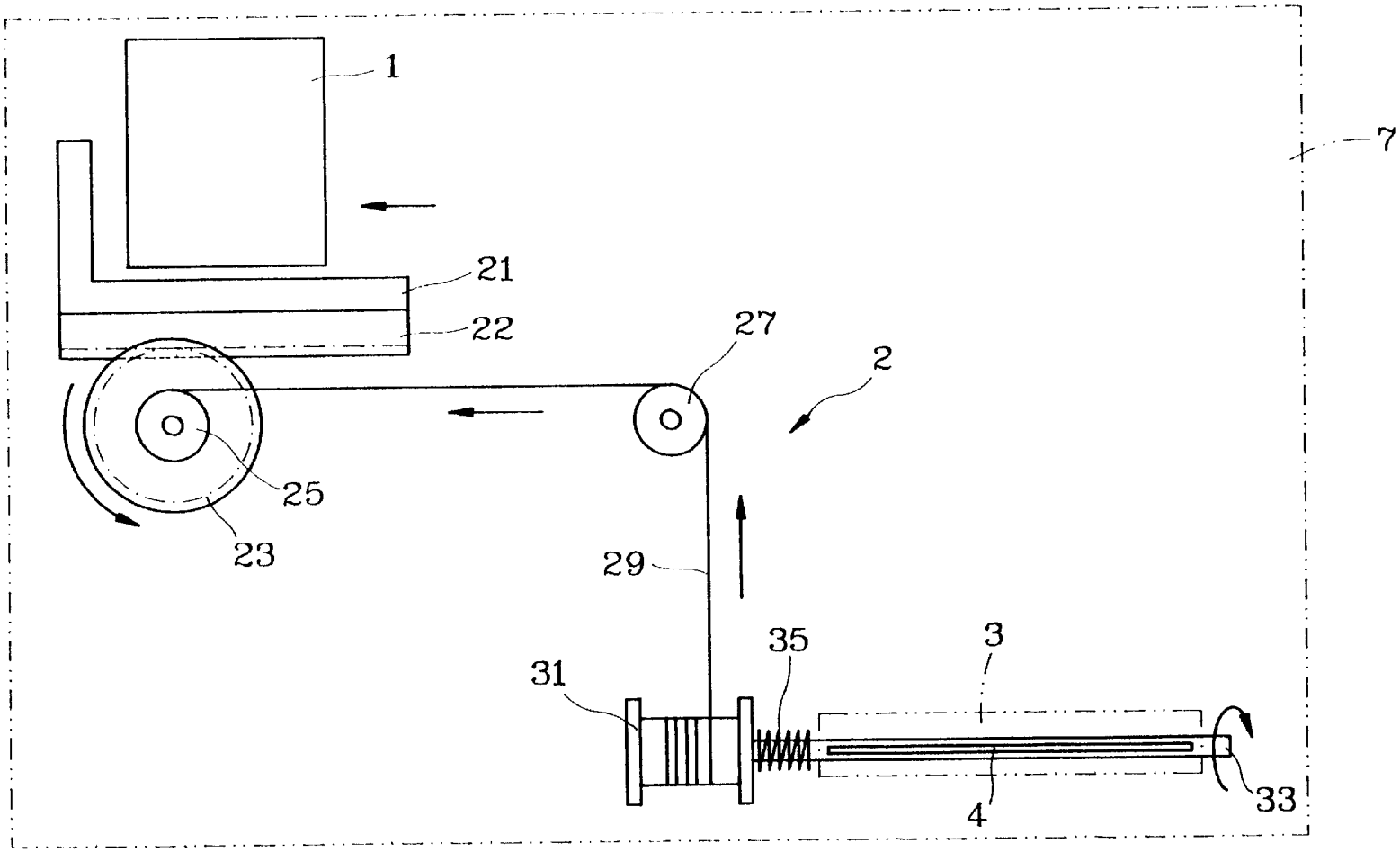
FIG. 1 is a schematic view of the preferred paper-loading mechanism for a document duplicating machine in accordance with the present invention.

The invention disclosed herein is directed to a paper-loading mechanism for a document duplicating machine. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

The paper-loading mechanism for a document duplicating machine according to the present invention, which is applied to a document duplicating machine having a reciprocating part and a paper loader with a base plate, comprises an actuating unit, a transmitting unit, and a paper-feeding unit. The so-called reciprocating part, which is used to provide the driving force to the paper-loading mechanism for a document duplicating machine during its end of motion stroke, can be an ink-spraying head, a read-and-write head, or any as the like in the document duplicating machine.

The actuating unit, which is utilized to provide reciprocating motion for the paper-loading mechanism for a document duplicating machine, can be a motion part, pushed by the reciprocating part, located along a line parallel, and adjacent to one end of the trajectory of the reciprocating part.

Preferably, the actuating unit comprises a sliding block, a rack fixed to the sliding block, and a driven gear meshed with the rack. Also, preferably, the actuating unit can comprise a slider and a swingarm.

The transmitting unit is connected with the actuating unit and used to transfer the reciprocating motion from the actuating unit to a feeding pushrod. The quantity of the transferred reciprocating motion to the feeding pushrod can be equivalent to, larger than, or smaller than the quantity of the reciprocating motion from the actuating unit, no matter by what means of gear set, friction wheel set, or any as the like. Preferably, the transmitting unit can be a rope-and-wheel combination, a gear set, a friction wheel set, or a pulley-and-belt set.

The paper-feeding unit, which is driven by the transmitting unit and transforms the input motion to rotation as one to push the lifting plate of the paper loader upwards for paper feeding, comprises preferably the feeding pushrod and a torsion spring. The feeding pushrod, which rotates along its own longitudinal central axis and further comprises a base plate fixed along the longitudinal surface, is located along one side of the paper loader of the document duplicating machine; with one end thereof connected with the torsion spring, and with the base plate extruding to bottom of one side of the base plate. Preferably, the lifting plate can be the base plate, thus it directly protrude to bottom of paper in the paper loader.

The torsion spring, with one end connected with the feeding pushrod and another connected with the transmitting unit, has its longitudinal central axis same as the central axis of the feeding pushrod and is used to restore torsion energy and to drive smoothly the feeding pushrod.

Referring now to FIG. 1, a schematic view of the preferred embodiment of the paper-loading mechanism for a document duplicating machine in accordance with the present invention is shown. Wherein, the actuating unit comprises a driving part and a driven part. The driving part is driven along with and by the reciprocating part 1 of the document duplicating machine at end stroke of the reciprocating part 1. The driven part transforms the linear motion from the driving part to rotation motion, and forwards the rotation motion to the transmitting unit.

As the preferred embodiment of the paper-loading mechanism for a document duplicating machine shown in FIG. 1, the driving part and the driven part are a sliding block 21 and a driven gear set, respectively. The sliding block 21 is directly driven by the reciprocating part 1. The driven gear set further includes a rack 22 fixed to the sliding block 21 with its longitudinal axis along the motion trajectory of the sliding block 21, and a driven gear 23 meshed with the rack 22.

The transmitting unit of the preferred embodiment of the paper-loading mechanism for a document duplicating machine according to the present invention comprises a rope-and-wheel combination, which includes a first rope wheel 25 as the input of the transmitting unit, a second rope wheel 31 as the output, a connecting rope 29 as connecting means between the first rope wheel 25 and the second rope wheel 31, and at least one idle wheel 27 to go with the connecting rope 29 for direction changing.

The first rope wheel 25 is fixed to the driven gear 23, and both utilize same rotation axis. The second rope wheel 31 and the paper-feeding pushrod 33 are co-rotation axis, and connected via the torsion spring 35. The paper-feeding pushrod 33, located along one lower side of the paper loader 3, has a base plate 4 extruding into the bottom of the paper loader 3.

While the preferred embodiment of the paper-loading mechanism for a document duplicating machine, as shown in FIG. 1, in action, the sliding block 21 is driven by the reciprocating part 1 at one end of its motion stroke. The sliding block 21 then drives the driven gear 23, via the rack 22. The first rope wheel 25, rotating with the driven gear 23, drives the second rope wheel 31 through the connecting rope 27. Then, the base plate 4 of the paper-feeding pushrod 33 is driven upwards by the second rope wheel 31, via the torsion spring 35. At the same time as the base plate 4 rotating upwards, the torsion spring 35 stores the torsion energy for later usage in restoring the paper-loading mechanism for a document duplicating machine back to its origin while the reciprocating part 1 and the sliding block 21 disengaged.

Figure 2A:
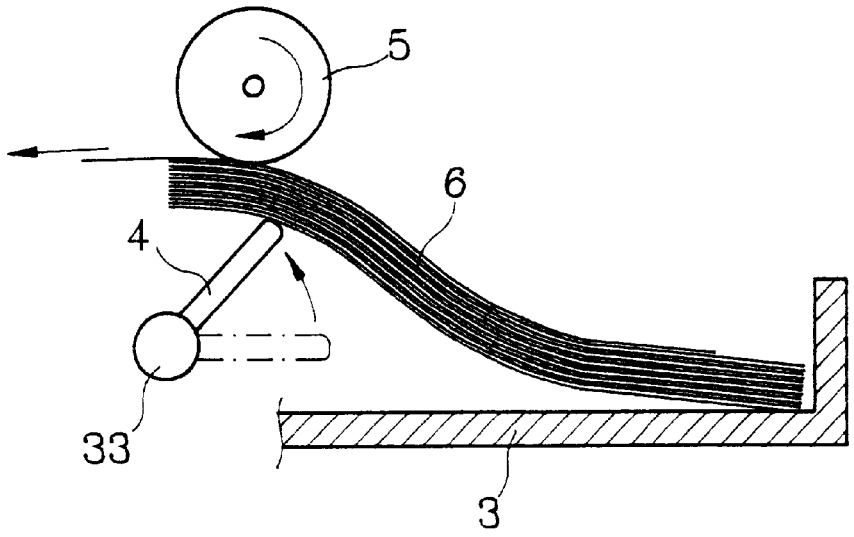
FIG. 2A is a schematic view of the preferred embodiment of the paper-feeding pushrod in accordance with the present invention at two different motion positions; where the base plate is connected directly to the longitudinal surface of the paper-feeding pushrod.

Referring now to FIG. 2A, a schematic view of the preferred embodiment of the paper-feeding pushrod 33 in accordance with the present invention is illustrated at two different motion positions. Wherein, the base plate 4 is driven upwards by rotating the paper-feeding pushrod 33 to lift one end of paper 6 in the paper loader 3, so as to have top sheet of the paper 6 contacted with the conveying roller 5 of the document duplicating machine, and thereby the top sheet of the paper 6 can be fed by the rolling of the conveying roller 6.

Figure 2B:
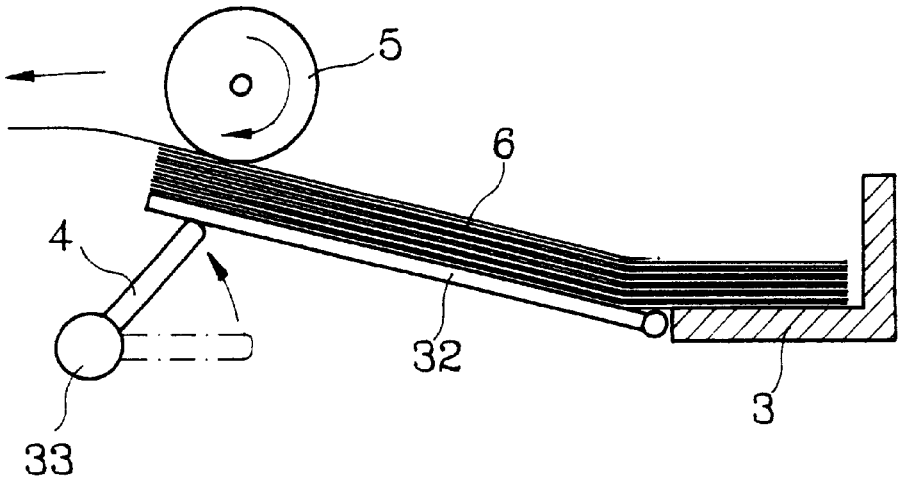
FIG. 2B is a schematic view of another embodiment of the paper-feeding pushrod in accordance with the present invention at two different motion positions; where a lifting plate is located under the paper in the paper loader and the base plate is located under the lifting plate.

Refer now to FIG. 2B, which shows another embodiment of the paper-feeding pushrod 33 in accordance with the present invention at two different motion positions. Wherein a lifting plate 32 is located tinder the paper 6 in the paper loader 3, and the base plate 4 is located under the lifting plate 32. While in action, the base plate 4 is driven upwards by rotating the paper-feeding pushrod 33 to lift one end of the lifting plate 32 as well as paper 6 on top of the lifting plate 32 in the paper loader 3, so as to have top sheet of the paper 6 contacted with the conveying roller 5 of the document duplicating machine, and thereby the top sheet of the paper 6 can be fed by the rolling of the conveying roller 6.

In the aforesaid description, the preferred embodiment of the actuating unit comprises the sliding block 21, the rack 22, and the driven gear 23. In fact, according to the present invention, the rack 22 and the driven gear 23 can also be replaced with a friction belt and a friction wheel, respectively. Moreover, in another embodiment according to the present invention, a combination of a slider and a swingarm can also be an alternative to the actuating unit. In the slider-and-swingarm combination, the slider is used to replace the sliding block of the preferred embodiment of the actuating inut described above; and one end of the swingarm is pivotedly connected to the document duplicating machine and the other end of the swingarm is pivotedly and motionly in longitudinal direction connected to the slider. The motion of the reciprocating part 1 is then adopted by the slider, and sent to the transmitting unit by the swingarm. Various means can be applied to connect the swingarm and the transmitting unit; ex., tightening the connecting rope 27 directly to a proper position on the swingarm (while the first rope wheel 25 is canceled), or fixing the swingarm to the first rope wheel 25 and in order to rotate the first rope wheel synchronically.

According to the present invention, the transmitting unit can be a gear set, a friction wheel set, a pulley-and-belt combination, or any means as the like. If a gear set is used as the transmitting unit, it may comprise at least an input gear and an output gear. The input gear can also be the driven gear 23 of the actuating unit, a gear co-axial and co-rotating with the driven gear 23, or a gear meshed with the driven gear 23. On the other hand, the output gear should be co-axial and co-rotating with the paper-feeding pushrod 33, via the torsion spring 35. If a friction gear set is used as the transmitting unit, it may comprise at least an input friction wheel and an output friction wheel. The input friction wheel can also be the driven friction wheel of the actuating unit, a friction wheel co-axial and co-rotating with the driven gear 23/driven friction wheel, or a friction wheel contacted with the driven friction wheel. On the other hand, the output friction wheel should be co-axial and co-rotating with the paper-feeding pushrod 33, via the torsion spring 35. If a pulley-and-belt combination is used as the transmitting unit, it may comprise at least an input pulley, an output pulley, and a connecting belt. The input pulley is co-axial and co-rotating with the driven gear 23 or the driven friction wheel, and the output pulley should be co-axial and co-rotating with the paper-feeding pushrod 33, via the torsion spring 35.

Figure 3:
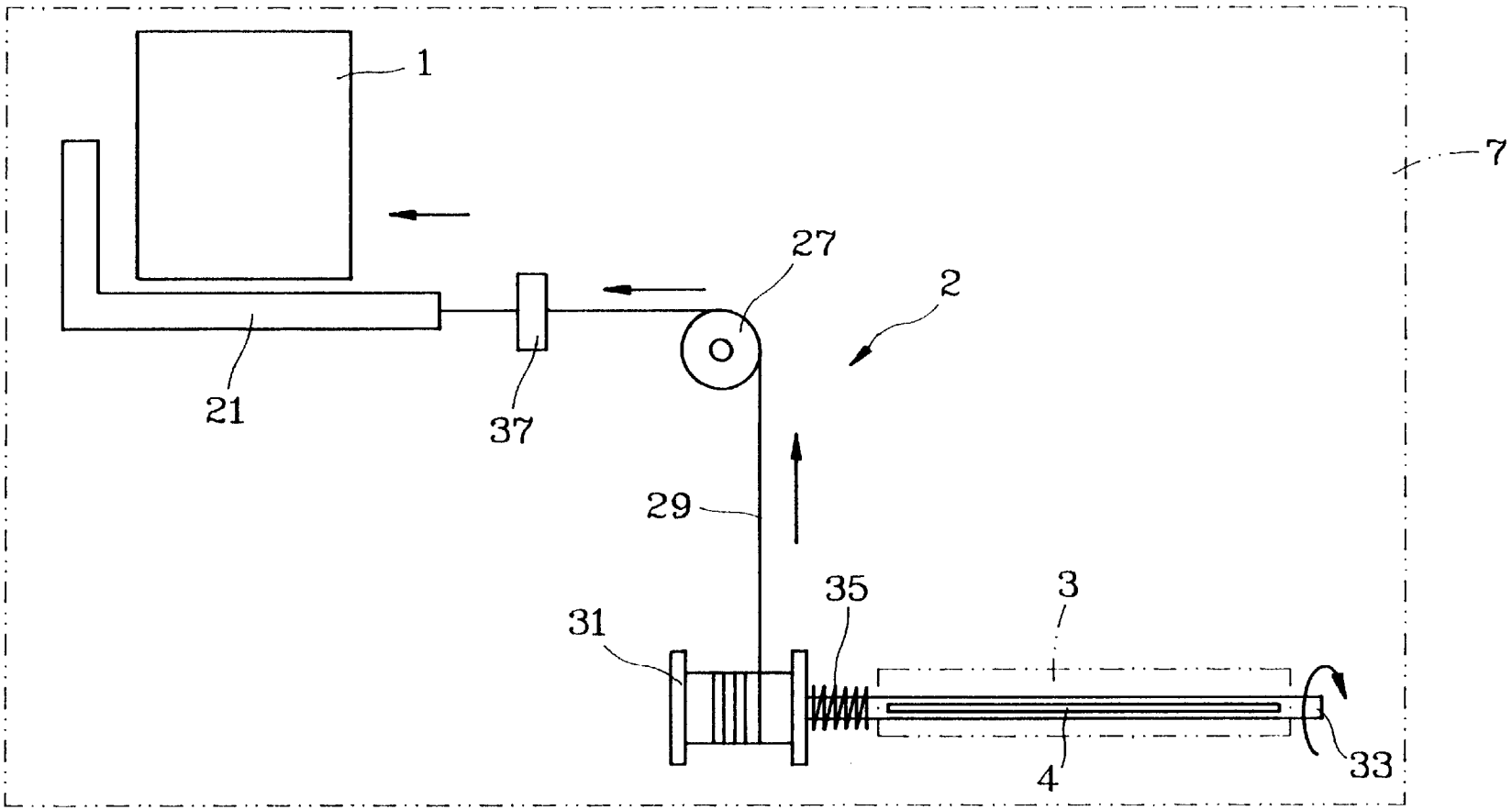
FIG. 3 is a schematic view of another embodiment of the paper-loading mechanism for a document duplicating machine in accordance with the present invention.

Referring now to FIG. 3, a schematic view of another embodiment of the paper-loading mechanism for a document duplicating machine in accordance with the present invention is shown. Wherein, the actuating unit comprises only a sliding block 21, and the transmitting unit comprises a connecting rope 29 and a second rope wheel 31. The motion range of the sliding block 21 is regulated by at least a restraint 37. The transmitting unit can further comprise an idle wheel to alter the direction of the connecting rope 29.

Wile the present invention has been particularly shown and described with reference to a preferred embodiment, it will be understood by those skilled in the art that various changes in form and detail may be without departing from the spirit and scope of the present invention.

What is claimed is:

1. A paper-loading mechanism for a document duplicating machine, said paper-loading mechanism being driven by a reciprocating part of a document duplicating machine to perform a periodical paper-loading control on a paper loader of the document duplicating machine, and comprising:

an actuating unit, to provide a reciprocating motion for the paper-loading mechanism, the actuating unit is pushed by the reciprocating part along a line parallel and adjacent to one end of the trajectory of the reciprocating part and comprises:

a sliding block, which is driven by the reciprocating part;

a rack, which is fixed to one side of the sliding block, with its longitudinal direction to parallel to the trajectory of the reciprocating part; and a driven gear, which is meshed with the rack and is the output of the actuating unit;

a transmitting unit, which is connected with the driven gear of the actuating unit and is used to transfer the reciprocating motion from the actuating unit to a paper-feeding pushrod;

wherein the paper-feeding pushrod is located along one side of the paper loader of the document duplicating machine and is rotatable along its own longitudinal central axis, the paper-feeding pushrod also comprises a base plate fixed along the longitudinal surface, with one end of the paper-feeding pushrod being connected with a torsion spring, and the base plate extending to a bottom of the paper loader;

further wherein the torsion spring is constructed to store a torsion energy and drive the paper-feeding pushrod smoothly, with one end of the torsion spring being connected with the paper-feeding pushrod and another end connected with the transmitting unit.

2. The paper-loading mechanism for a document duplicating machine according to claim 1, wherein said transmitting unit further comprises a first rope wheel as the input of the transmitting unit, a second rope wheel as the output, and a connecting rope as connecting means between the first rope wheel and the second rope wheel; having the first rope wheel co-axial and co-rotating with the driven gear, and the second rope wheel co-axial and co-rotating with the paper-feeding pushrod.

3. The paper-loading mechanism for a document duplicating machine according to claim 2, wherein said transmitting unit further comprises at least one idle wheel in middle of the connecting rope.

4. A paper-loading mechanism for a document duplicating machine, said paper-loading mechanism being driven by a reciprocating part in a document duplicating machine to perform a periodical paper-loading control on a paper loader of the document duplicating machine and comprising:

a sliding block, which is constructed to provide reciprocating motions for the paper-loading mechanism and is pushed by the reciprocating part along a line parallel to and adjacent of one end of the trajectory of the reciprocating part;

a connecting rope, having one end thereof connected with the sliding block and the other end thereof connected to wheel surface of a first rope wheel, the first rope wheel having a wheel surface connected with the connecting rope; and a paper-feeding pushrod, which is located along one side of the paper loader of the document duplicating machine and is rotatable along its own longitudinal central axis, the paper-feeding pushrod comprising a base plate fixed along a longitudinal surface, with one end thereof connected with a torsion spring, and with the base plate extending to a bottom of the paper loader;

wherein the torsion spring, which is constructed to store a torsion energy and to drive smoothly the paper-feeding pushrod, has one end connected with the paper-feeding pushrod and another end connected with the second rope wheel.

5. The paper-loading mechanism for a document duplicating machine according to claim 4, further comprises at least an idle wheel in middle of the connecting rope for direction changing.

* * * * *